US006176725B1

(12) United States Patent
Kobayashi et al.

(10) Patent No.: US 6,176,725 B1
(45) Date of Patent: Jan. 23, 2001

(54) CARD EDGE CONNECTOR

(75) Inventors: Katsuhiko Kobayashi, Uenohara-machi; Shinichi Hashimoto, Tokyo, both of (JP)

(73) Assignee: The Whitaker Corporation, Wilmington, DE (US)

( * ) Notice: Under 35 U.S.C. 154(b), the term of this patent shall be extended for 0 days.

(21) Appl. No.: 09/361,758

(22) Filed: Jul. 27, 1999

(30) Foreign Application Priority Data

| | | |
|---|---|---|
| Jul. 27, 1998 | (JP) | 10-210965 |
| Nov. 13, 1998 | (JP) | 10-323684 |
| Mar. 29, 1999 | (JP) | 11-85861 |

(51) Int. Cl.[7] ..... H01R 13/62
(52) U.S. Cl. ..... 439/326; 439/328
(58) Field of Search ..... 439/326–328, 439/372, 59, 65

(56) References Cited

U.S. PATENT DOCUMENTS

| | | | |
|---|---|---|---|
| 4,995,825 | 2/1991 | Korsunsky et al. | 439/328 |
| 5,013,257 | 5/1991 | Korsunsky et al. | 439/326 |
| 5,174,778 | 12/1992 | Lin | 439/326 |
| 5,366,390 | 11/1994 | Kinross et al. | 439/636 |
| 5,372,518 | 12/1994 | Liu et al. | 439/326 |
| 5,374,203 | 12/1994 | Sato et al. | 439/326 |
| 5,383,792 | 1/1995 | Korsunsky et al. | 439/326 |
| 5,437,560 | 8/1995 | Mizuguchi | 439/326 |
| 5,514,002 | 5/1996 | Cheng et al. | 439/326 |
| 5,669,782 * | 9/1997 | Yodogawa | 439/327 |
| 5,759,057 | 6/1998 | Cheng et al. | 439/328 |
| 5,769,668 | 6/1998 | Tondreault | 439/633 |
| 5,833,478 | 11/1998 | Tseng et al. | 439/326 |
| 5,839,913 | 11/1998 | Fumikura | 439/326 |
| 5,860,825 | 1/1999 | Yodogawa | 439/326 |
| 5,938,464 * | 8/1999 | Ichimura et al. | 439/327 |

FOREIGN PATENT DOCUMENTS

| | | | |
|---|---|---|---|
| 2649988 | 12/1991 | (JP) | H01R/23/68 |

* cited by examiner

*Primary Examiner*—Hien Vu

(57) ABSTRACT

The present invention provides a card edge electrical connector which makes it possible to achieve reliable grounding of a daughter board to a mother board via latch members thereof. Card edge connector (1) is equipped with an insulating housing (10), which is to be attached to a mother board (50) and which has a daughter board-accommodating recess (11) that extends in the direction of length thereof, and metal latch members (30), which are disposed in the vicinity of end portions of the housing (10) with respect to the direction of length of the housing and which hold a daughter board (60) at a second angle when the daughter board (60) is rotated to the second angle after being inserted into the daughter board-accommodating recess (11) at a first angle. The latch members (30) are connected to a ground path of the mother board (50). Metal ground auxiliary contact members (40), which have first resilient contact portions (43) that resiliently engage a ground path of the daughter board (60) and second resilient contact portions (44) that resiliently engage the latch members (30) are attached to the housing (10).

10 Claims, 9 Drawing Sheets

CARD EDGE CONNECTOR

FIELD OF THE INVENTION

The present invention relates to a card edge electrical connector which is to be mounted onto and electrically connected to a mother board, and to which a daughter board is electrically connected in a latchable manner.

BACKGROUND OF THE INVENTION

The electrical connector shown in FIG. 9 as disclosed in Japanese Patent No. 2,649,988 is a card edge electrical connector 100 which is attached to a mother board, and to which a daughter board is connected in a latchable manner.

Card edge connector 100 is equipped with an insulating housing 110, which has a daughter board-accommodating recess 111 extending in the direction of length thereof and latch-accommodating recesses 112 (only one being shown) located in both ends of the daughter board-accommodating recess 111 and which is attached to a mother board 130, a plurality of electrical contacts (not shown) are disposed in row form along the direction of length of the housing 110, and a pair of metal latch members 120 are accommodated in the latch-accommodating recesses 112 of the housing 110, and they are fastened to the housing 110. Furthermore, each of the electrical contacts is electrically connected by soldering to the mother board 130, and the metal latch members 120 are also attached to the mother board 130.

Furthermore, the daughter board 140 is accommodated at a first angle inside the daughter board-accommodating recess 111 of the housing 110, and it is then rotated in the direction indicated by arrow R in FIG. 9 so that the daughter board 140 electrically engages the electrical contacts at a second angle; the second angle is maintained by the latch members 120. As a result, the daughter board 140 is electrically connected to the mother board 130 via the electrical contacts of the card edge connector 100. Moreover, when the daughter board 140 is held by the latch members 120, the daughter board 140 enters the daughter board-accommodating openings 121 of the latch members 120, and it is held in a specified position by the latch projections 122 of the latch members 120 and stop members 113 of the housing 110.

Grounding of the daughter board 140 to the mother board 130 is accomplished by electrically connecting ground path 141 on the daughter board 140 with a ground path (not shown) on the mother board 130 via the latch members 120, i.e., by causing the ground path 141 on the daughter board 140 to electrically engage the latch members 120.

However, in conventional card edge connector 100, the width of the portions of the latch members 120 electrically engaging the ground path 141 on the daughter board 140, i.e., the width of the daughter board-accommodating openings 121 of the latch members 120, is slightly larger than the thickness of the daughter board 140. As a result, in cases where a force oriented in the direction indicated by arrow R acts on the daughter board 140 as a result of some external cause, there is a danger that the ground path 141 on the daughter board 140 will be separated from the latch members 120, so that grounding of the daughter board 140 to the mother board 130 cannot be accomplished. On the other hand, if the width of the daughter board-accommodating openings 121 in the latch members 120 is made the same as the thickness of the daughter board 140 in order to prevent rotation of the daughter board 140 inside the daughter board-accommodating openings 121, there is a danger that the daughter board 140 will be unable to enter the daughter board-accommodating openings 121 as a result of dimensional error.

SUMMARY OF THE INVENTION

Accordingly, an object of the present invention is to provide a card edge electrical connector which can reliably accomplish grounding of a daughter board to a mother board via latch members.

A card edge electrical connector of the present invention is equipped with an insulating housing which is to be attached to a mother board and which has a daughter board-accommodating recess that extends in a direction of length thereof, and metal latch members are disposed in the vicinity of end portions of the housing with respect to the direction of length of the housing and which hold a daughter board at a second angle when the daughter board is rotated to the second angle after being inserted into the daughter board-accommodating recess at a first angle, the latch members are electrically connected to a ground path of the mother board, and metal ground auxiliary contact members having a first resilient contact member that resiliently engages the ground path of the daughter board and a second resilient contact member that resiliently engages one of the latch members are attached to the housing.

Furthermore, it is effective if the first resilient contact member of each ground auxiliary contact member flexes in a direction that causes an increase in the resilient force applied to the daughter board when the first resilient contact member resiliently engages the ground path of the daughter board upon the rotation of the daughter board from the first angle to the second angle. The resilient contact member, which electrically engages the ground path of the daughter board, is integral with each of the latch members.

It is desirable that an overstress prevention member, which prevents excessive flexing of the resilient contact member, be integral with each of the latch members.

Furthermore, it is advisable that the latch members be equipped with two plate sections that are folded and superimposed on each other, a connection member, which is connected with the ground path of the mother board, a daughter board-holding member, which holds the daughter board at the second angle, and the overstress prevention member, be integrally formed on one of the plate sections, and the resilient contact member be integrally formed on the other of the plate sections.

Furthermore, it is effective if the overstress prevention member engages the second plate section when the daughter board held by the daughter board-holding member is forcibly driven upward, thereby preventing the first plate section from floating upward.

It is much more effective if an excessive movement-prevention member, which prevents excessive movement of the daughter board when the daughter board engages the resilient contact member, is integrally formed on the first plate section.

In addition, it is much more effective if the excessive movement-prevention member prevents excessive displacement of the first plate section to the outside by engaging the second plate section when the daughter board-holding member is displaced to the outside so that the holding of the daughter board is released.

An electrical connector for electrical connection to a mother board and for receiving a daughter board which comprises a dielectric housing having a board-accommodating recess extending therealong in which an edge of the daughter board is to be accommodated; electrical contacts mounted in the dielectric housing and having contact sections for electrical connection to the daughter board and connection sections for electrical connection to the mother board when the dielectric housing is mounted thereon; and metal latch members mounted on the dielectric housing adjacent respective ends of the board-accommodating recess and having connection sections for electrical connection to a ground path on the mother board, board-holding members for engaging a surface of the daughter board and holding the daughter board at a second angle after the edge of the daughter board has been inserted into the board-accommodating recess at a first angle and then moved to the second angle, and resilient contact sections for electrical connection to a grounding path on the daughter board.

BRIEF DESCRIPTION OF THE DRAWINGS

Embodiments of the present invention will now be described by way of example with reference to the accompanying drawings in which:

FIG. 5A is a part top plan view, FIG. 5B is a part front view, and FIG. 5C is a part cross-sectional view taken along line 5C—5C in FIG. 5A.

FIG. 6A is a plan view, FIG. 6B is a front view, and FIG. 6C is a right-side view of FIG. 6A.

FIG. 7A is a front view, and FIG. 7B is a part cross-sectional side view.

FIG. 8A is a cross-sectional view showing the daughter board inserted at a first angle, and FIG. 8B is a cross-sectional view showing the daughter board rotated to a second angle.

DETAILED DESCRIPTION OF THE INVENTION

Figures 1, 2:
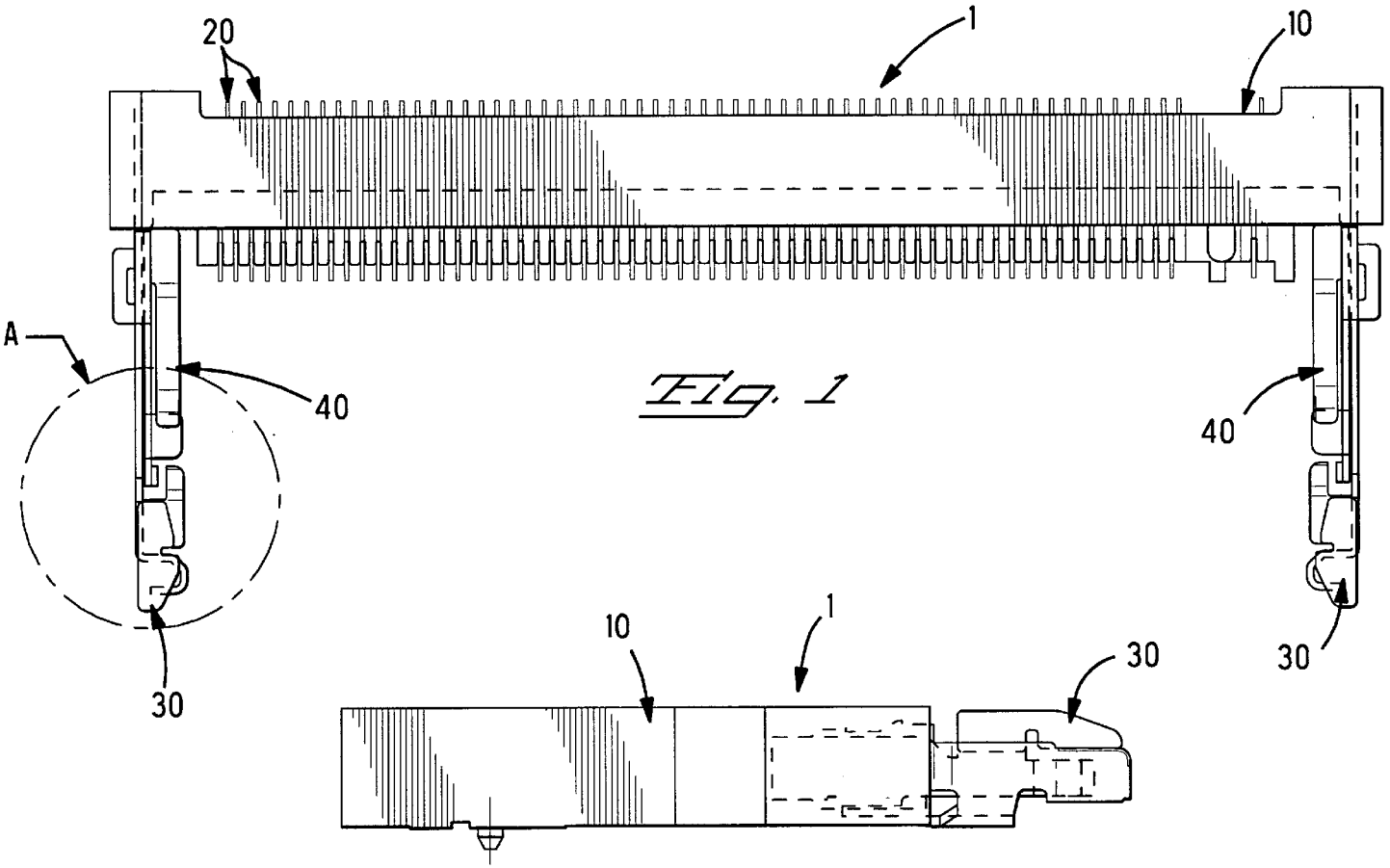
FIG. 1 is a top plan view of a card edge electrical connector of the present invention.
FIG. 2 is a left-side view of the card edge connector shown in FIG. 1.
Figure 3:
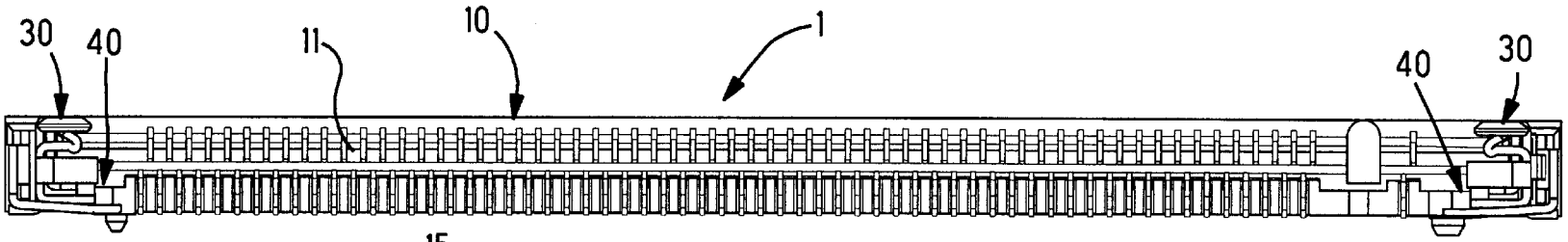
FIG. 3 is a front view of the card edge connector shown in FIG. 1 with electrical contacts omitted therefrom.

In FIGS. 1–4 and FIG. 8, card edge electrical connector 1 is equipped with an insulating housing 10, which is attached to a mother board 50 and which has a daughter board-accommodating recess 11 that extends in the direction of length, a plurality of electrical contacts 20, which are electrically connected to the mother board 50 and which are arranged in upper and lower rows along the direction of length of the housing 10, a pair of metal latch members 30, which are disposed in the vicinity of both end portions of the housing 10, with respect to the direction of length of the housing 10 and which hold a daughter board 60 at a second angle after the daughter board has been inserted into the daughter board-accommodating recess 11 at a first angle and then rotated to the second angle, and a pair of metal ground auxiliary contact members 40, which are attached to the housing 10 and which also resiliently engage a ground path (not shown) of the daughter board 60 and resiliently engage the latch members 30. Furthermore, when the daughter board 60 is inserted into the daughter board-accommodating recess 11 at the first angle (see FIG. 8A), the daughter board 60 enters the area between the rows of electrical contacts 20 arranged in upper and lower rows; then, when the daughter board 60 is rotated and held at the second angle (see FIG. 8B), the daughter board 60 electrically engages the electrical contacts 20 in the upper and lower rows. As a result of this, the daughter board 60 and mother board 50 are electrically connected to each other. Here, in the present embodiment, the first angle is an angle inclined by approximately 30 degrees with respect to the mother board 50, while the second angle is an angle that is substantially parallel to the mother board 50; however, the angles used are not limited to these angles.

Figure 4:
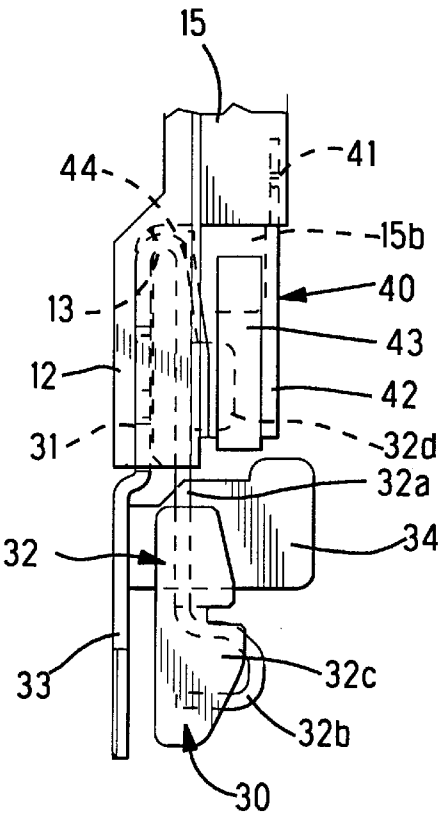
FIG. 4 is an enlarged view of a portion indicated by arrow A in FIG. 1.
Figure 5A:
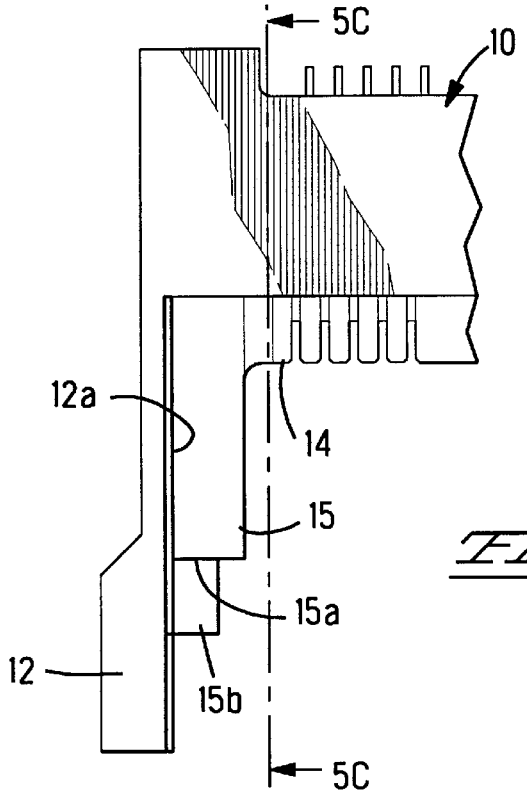
FIGS. 5A–5C show a dielectric housing used in the card edge electrical connector shown in FIG. 1.
Figure 5B:
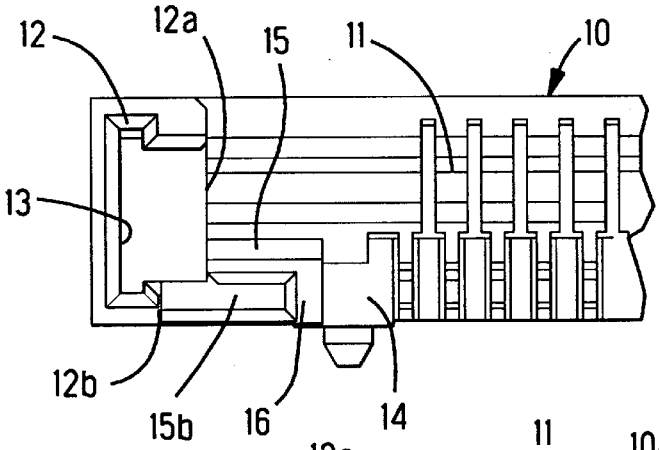
Figure 5C:
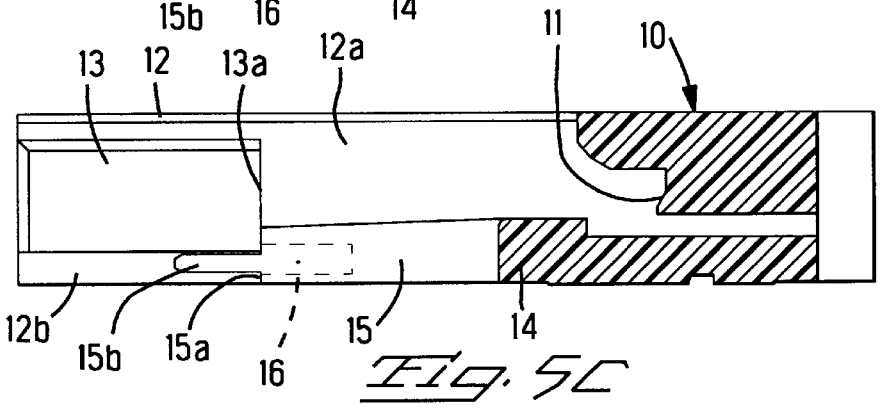
Figure 7A:
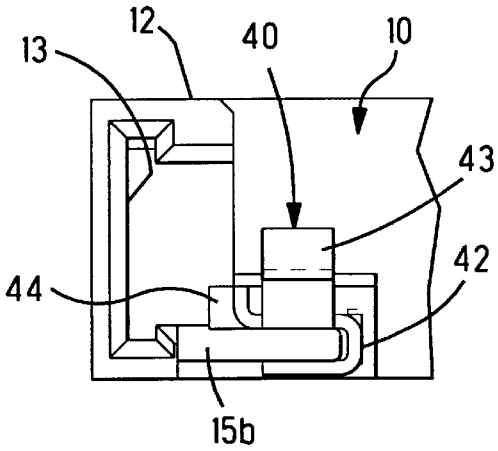
FIGS. 7A and 7B show a ground auxiliary contact member attached to the housing.
Figure 7B:
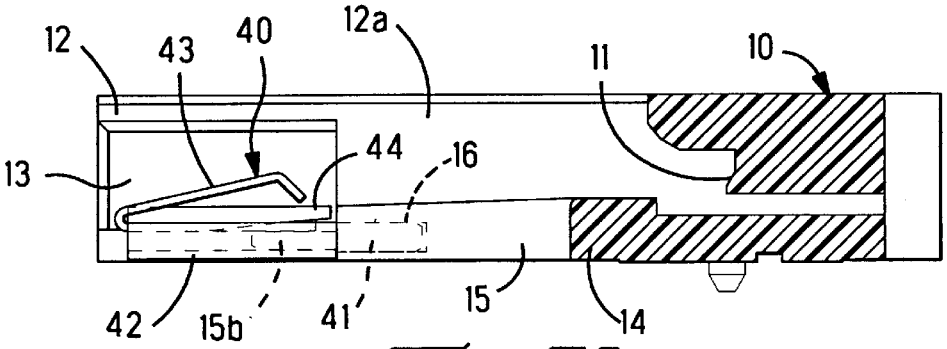

Here, as shown in FIGS. 1–5, the housing 10 is an integral member with insulating properties, which is molded substantially in the shape of a rectangular solid with the daughter board-accommodating recess 11 extending in the direction of length inside. A pair of arm members 12 extend as protruding members from both end portions of the housing 10. As shown in FIGS. 4, 5 and 7, latch-accommodating recesses 13, which accommodate the latch members 30 and to fasten the latch members 30 by press-fitting therein, are located in the respective arm members 20. Furthermore, a pair of seat members 15, which communicate with the side walls 12*a* of the arm members 12 are protruding members on both ends of a bottom wall 14 of the daughter board-accommodating recess 11, and a press-fitting recess 16, in which the press-fitting section 41 of the corresponding ground auxiliary contact member 40 (described later) is press-fitted, is located in each of the seat members 15. The end 15*a* of each seat member 15 is located in the same plane as the rear wall 13*a* (with respect to the forward-rearward direction, i.e., the left-right direction in FIG. 5C) of the latch-accommodating recess 13 in each arm member 12. A long and slender projecting section 15*b*, which communicates with the other side wall 12*b* of the corresponding arm member 12, and which is recessed further than the side wall 12*a*, is as a protruding section on the end 15*a* of each seat member 15.

Furthermore, the latch members 30 are formed by stamping and forming metal sheets. As shown most clearly in FIGS. 4 and 8, each of the latch members 30 is equipped with a press-fitting plate section 31, which is press-fitted in the corresponding latch-accommodating recess 13 of the housing 10, a daughter board-holding section 32, which is folded forward from the press-fitting plate section 31 in substantially a U-shape therefrom, an overstress-prevention section 33, which extends forward from the press-fitting plate section 31, and a connection section 34, which is bent inward (toward the right in FIG. 4) from a lower end of the overstress-prevention section 33 and which is connected by soldering to a ground path (not shown) of the mother board 50. For example, stainless steel sheets are desirable as the metal sheets from which the latch members 30 are stamped and formed. The daughter board-holding section 32 is equipped with a plate section 32*a,* which is folded back in substantially a U-shape from the press-fitting plate section 31, a hook section 32*b,* which is located at an outer end of the plate section 32*a* and which protrudes inward, and a daughter board-holding member 32*c,* which is bent inward from an upper end of the plate section 32*a*. Here, as shown in FIG. 8, the daughter board-holding member 32*c* is temporarily moved to the outside by the resilient force of the plate section 32*a* when the daughter board 60 inserted into the daughter board-accommodating recess 11 rotates from the first angle to the second angle; the daughter board-holding member 32*c* then returns to its original position so that it engages an upper surface of an edge portion of the daughter board 60, thereby preventing the daughter board 60 from floating upward. Furthermore, the hook section 32*b* enters a cut-out (not shown) in the-edge portion of the daughter board 60 when the daughter board 60 is positioned at the second angle, so that the daughter board 60 is prevented from slipping out of the connector 1. Furthermore, when the daughter board-holding section 32 attempts to flex outward by an excessive amount, the daughter board-holding portion 32*c* engages the overstress-prevention section 33, so that the application of an excessive stress to the plate section 32*a* is prevented. Furthermore, the latch members 30 are press-fitted in the latch-accommodating recesses 13 after the ground auxiliary contact members 40 (described later) have been fastened to the housing by press-fitting as shown in FIG. 7.

Figure 6B:
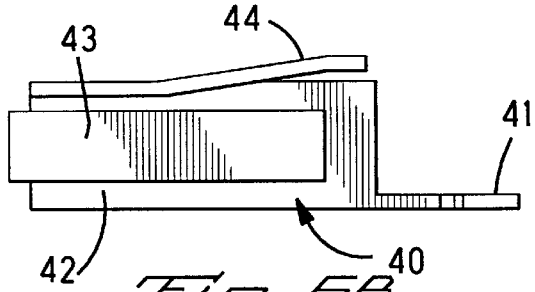
FIGS. 6A–6C show a ground auxiliary contact member used in the card edge electrical connector shown in FIG. 1.
Figure 6A:
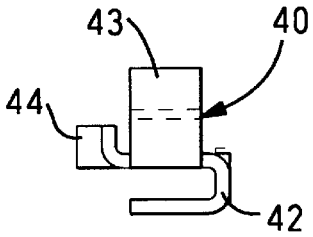
Figure 6C:
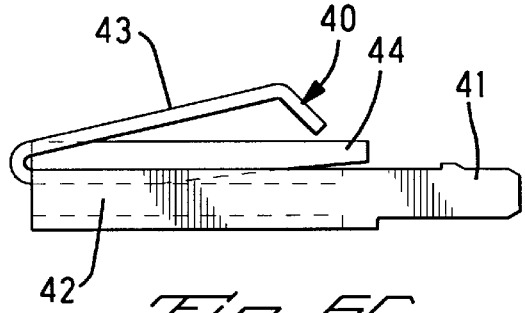

The ground auxiliary contact members 40 are formed by stamping and forming metal plates. As shown most clearly in FIGS. 6 and 7, each of the ground auxiliary contact members 40 is equipped with a press-fitting plate portion 41, which is press-fitted inside the corresponding press-fitting recess 16 of the housing 10, a U-shaped portion 42, which extends forward from the press-fitting plate portion 41, a first resilient contact portion 43, which is folded back from a front end of an upper leg of the U-shaped portion 42 so that it extends toward a rear end thereof with an upward inclination in the form of a cantilever member and which resiliently engages the ground path (not shown) on an undersurface of the daughter board 60, and a second resilient contact portion 44, which is bent upward from a side edge of the upper leg of the U-shaped portion 42 so that it extends rearward toward the outside in the form of a cantilever member and which resiliently engages a side surface of the plate section 32*a* of the corresponding latch member 30 (see FIG. 4). For example, it is desirable that stainless steel be used as the metal plates of the ground auxiliary contact members 40. The U-shaped portion 42 of each ground auxiliary contact member 40 clamps onto projection 15*b* on the housing 10 as shown in FIG. 7A when the press-fitting plate portion 41 of the ground auxiliary contact member 40 is press-fitted in the press-fitting recess 16 of the housing 10 thereby assisting in restricting the movement of the ground auxiliary contact member 40 in the vertical direction. Furthermore, when the latch member 30 is press-fitted inside the latch-accommodating recess 13, a projecting section 32*d,* which is bent inward from the lower end of the plate section 32*a* of the latch member 30 enters the U-shaped portion 42 as shown in FIG. 4, thereby assisting in restricting the movement of the latch member 30 in the vertical direction. Furthermore, when the press-fitting plate section 31 of the latch member 30 is press-fitted inside the latch-accommodating recess 13 after the press-fitting plate portion 41 of the ground auxiliary contact member 40 has been press-fitted inside the press-fitting recess 16, the second resilient contact portion 44 resiliently engages the side surface of the plate section 32*a* of the latch member 30 as shown in FIGS. 4 and 8. Since the resilient force of the second resilient contact portion 44 is much smaller than the resilient force of the plate section 32*a* of the latch member 30, the daughter board-holding member 32*c* of the latch member 30 is not removed from the edge of the daughter board 60 by the resilient force of the second resilient contact portion 44. Meanwhile, when the daughter board 60 rotates from the first angle to the second angle as shown in FIG. 8, the first resilient contact portion 43 electrically engages the ground path of the daughter board 60, and flexes in such a direction that the resilient force applied to the daughter board 60 is increased.

Figure 8A:
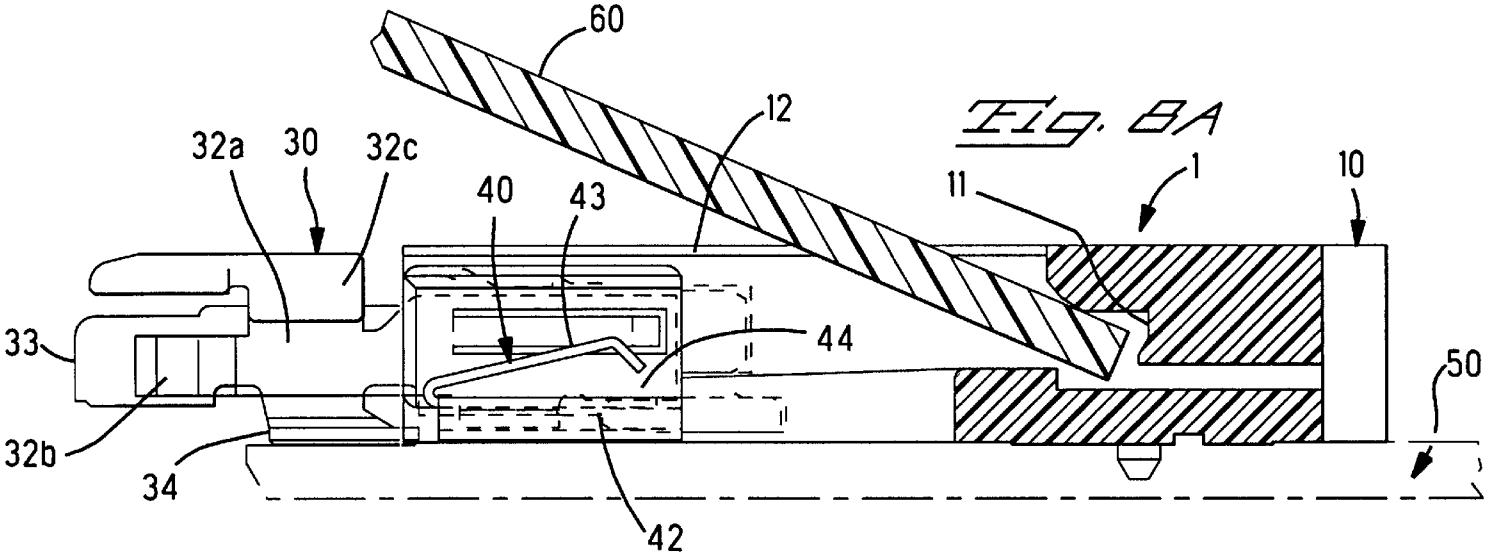
FIGS. 8A and 8B show the rotating operation of a daughter board inserted into the card edge electrical connector shown in FIG. 1.
Figure 8B:
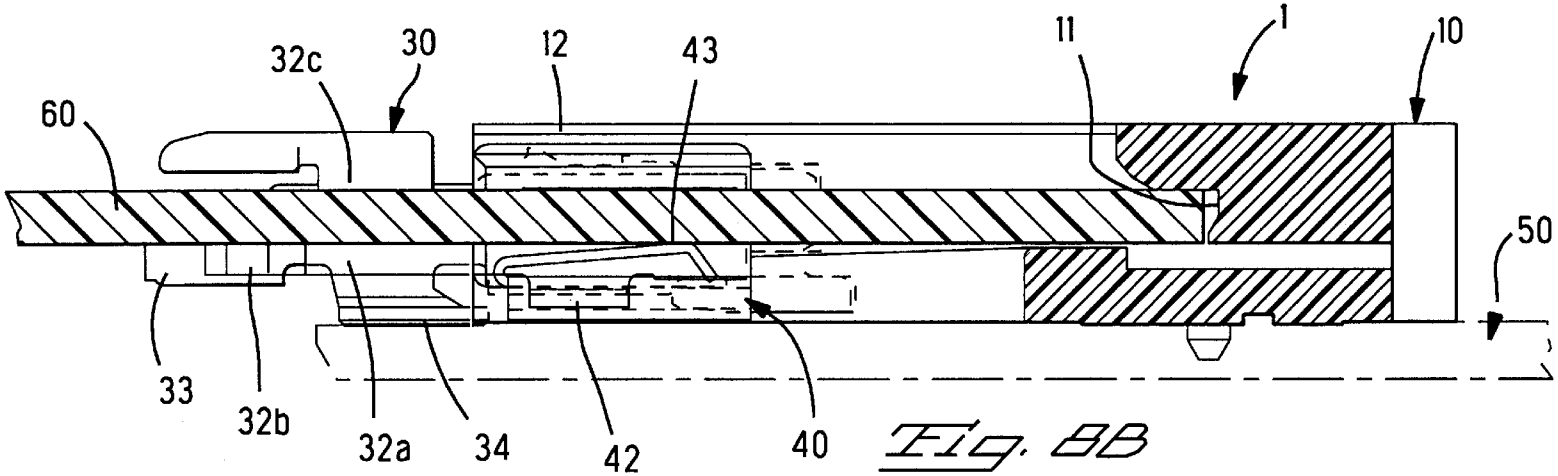
Figure 9:
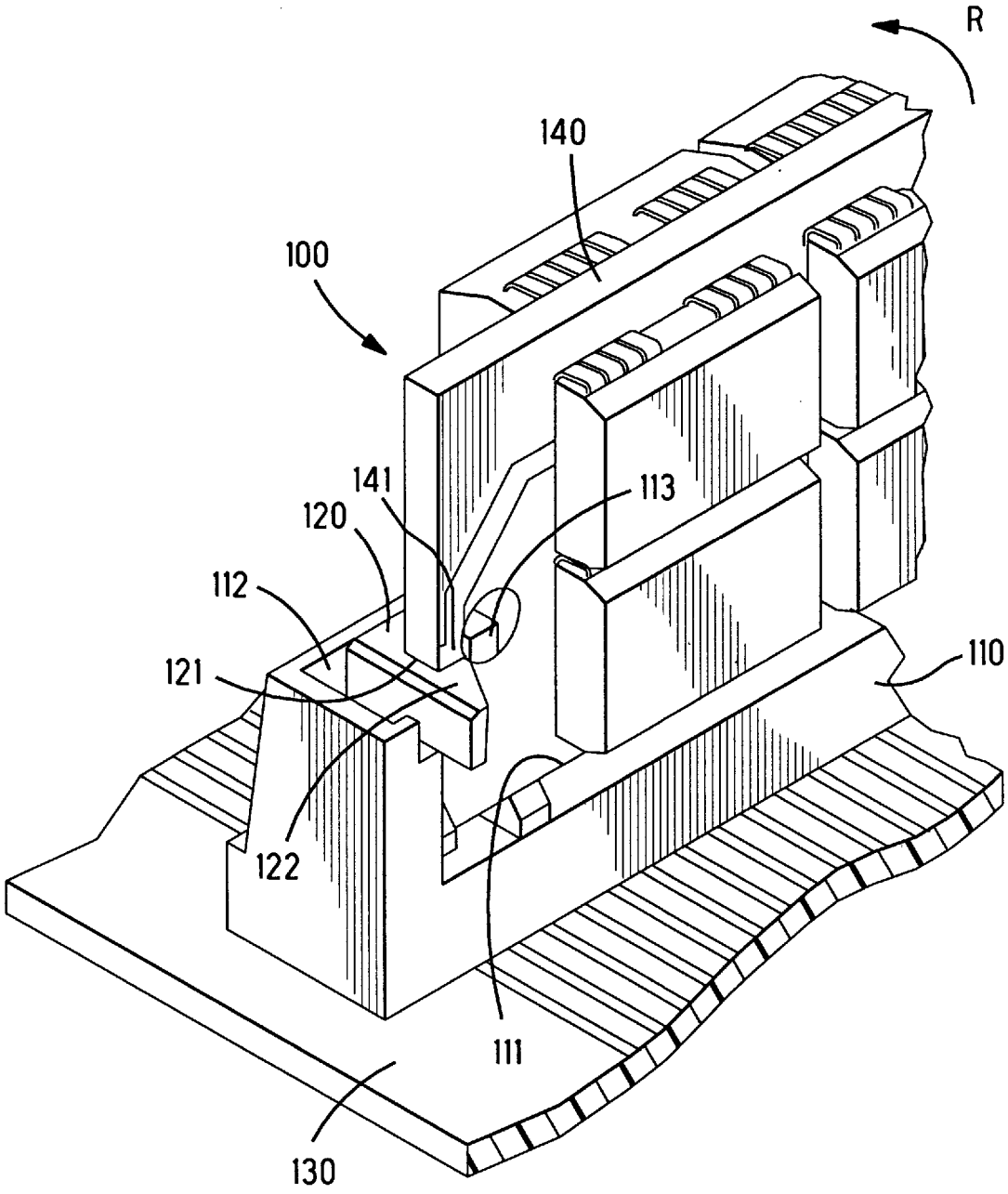
Fig. 9 Prior Art
FIG. 9 is a part perspective view of a conventional card edge electrical connector.

As shown in FIG. 8B, when the daughter board 60 is held at the second angle, the first resilient contact portion 43 of each ground auxiliary contact member 40 electrically engages the ground path of the daughter board 60; furthermore, the second resilient contact portion 44 electrically engages the plate section 32*a* of the corresponding latch member 30, and the solder section 34 of the latch member 30 is connected by soldering to the ground path of the mother board 50. Accordingly, the ground path of the daughter board 60 is grounded to the ground path of the mother board 50. In this case, even if the daughter board 60 is further rotated from the second angle as a result of some external cause so that the daughter board 60 is removed from the daughter board-holding members 32*c* of the latch members 30, the grounded state of the daughter board 60 with respect to the mother board 50 is not disrupted, since the first resilient contact portions 43 of the ground auxiliary contact members 40 are in electrical engagement with the ground path of the daughter board 60. Furthermore, the first resilient contact portions 43 electrically engage the ground path of the daughter board 60 and flex in a direction that causes an increase in the resilient force applied to the daughter board 60 when the daughter board 60 rotates from the first angle to the second angle; accordingly, even if the daughter board 60 is caused to rotate further from the second angle, the resilient force applied to the daughter board 60 by the first resilient contact portions 43 is greatly increased, so that the first resilient contact portions 43 are reliably prevented from leaving the daughter board 60, thereby insuring a much more reliable grounding connection of the daughter board 60 to the mother board 50.

Next, an alternative embodiment of the card edge electrical connector of the present invention will be described with reference to FIGS. 10–16. Card edge electrical connector 201 is equipped with an insulating housing 210, which is attached to a mother board 240 and which has a daughter board-accommodating recess 211 that extends in the direction of length, a plurality of electrical contacts 220, which are electrically connected to the mother board 240 and which are arranged in upper and lower rows along the direction of length of the housing, and a pair of metal latch members 230, which are disposed in the vicinity of end portions of the housing 210 with respect to the direction of length of the housing 210 and which hold a daughter board 250 (FIG. 16) at a second angle when the daughter board is rotated to the second angle after being inserted into the daughter board-accommodating recess 211 at a first angle. The card edge electrical connector 201 differs from the card edge electrical connector 1 shown in FIGS. 1–8 in that no ground auxiliary contact members are provided. Furthermore, when the daughter board 250 is inserted into the daughter board-accommodating recess 211 at the first angle, the daughter board 250 enters the area between the upper and lower rows of electrical contacts 220; then, when the daughter board 250 is rotated and held at the second angle (see FIG. 16), the daughter board 250 electrically engages the contacts 220 of the upper and lower rows, so that the daughter board 250 is electrically connected to the mother board 240 thereby.

Figure 10:
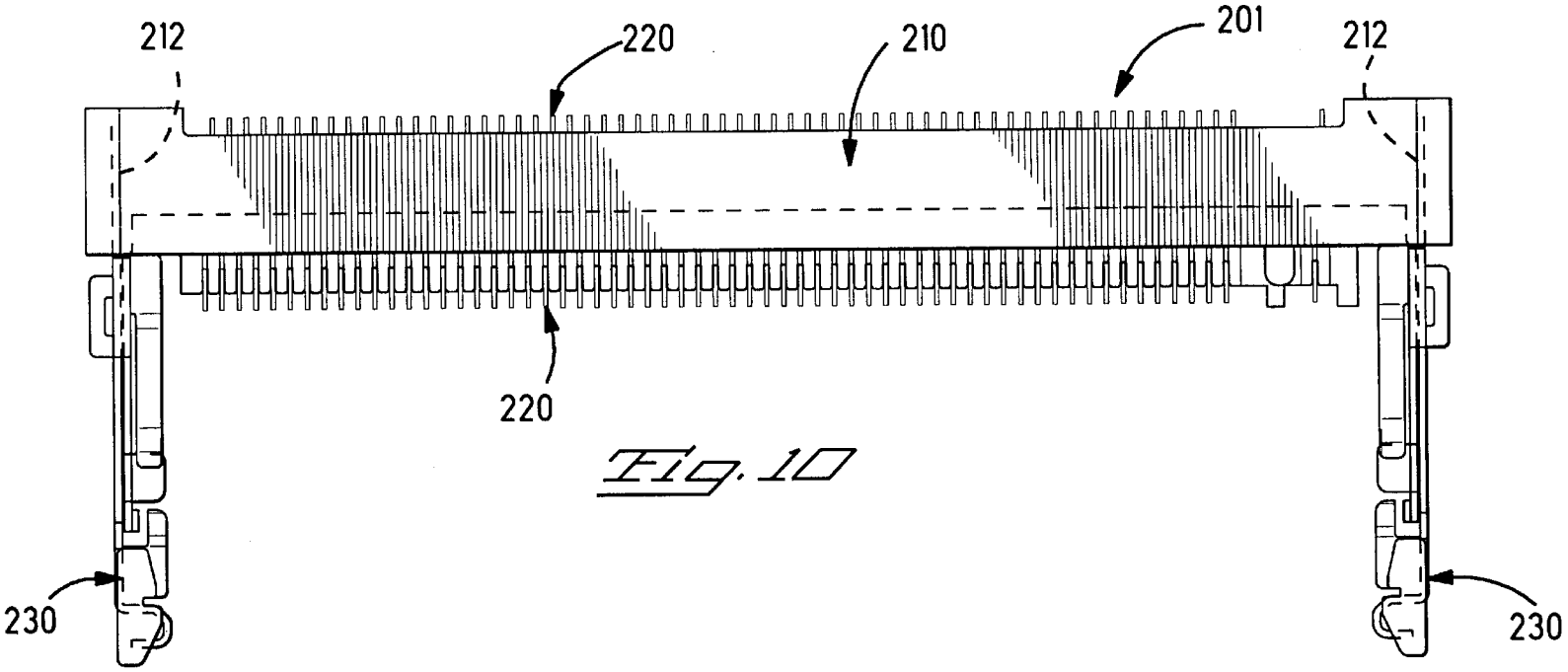
FIG. 10 is a top plan view of an alternative embodiment of the card edge electrical connector of the present invention.
Figure 11:
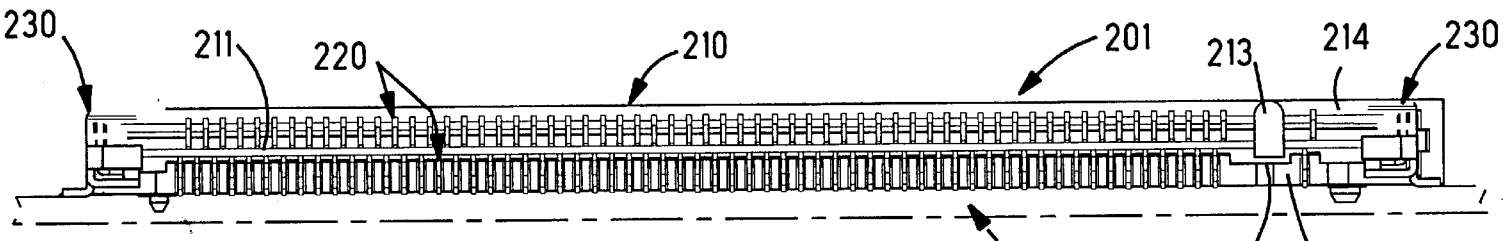
FIG. 11 is a front view of the card edge electrical connector shown in FIG. 10.
Figure 12:
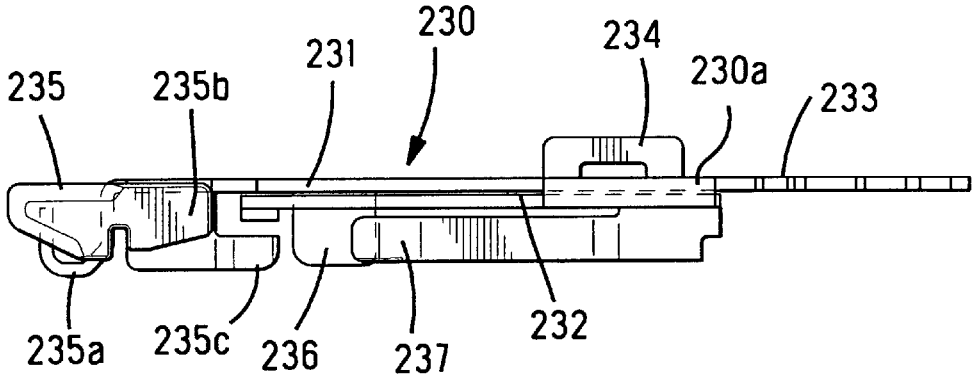
FIG. 12 is a top plan view of one latch member used in the card edge electrical connector shown in FIG. 10.
Figure 13:
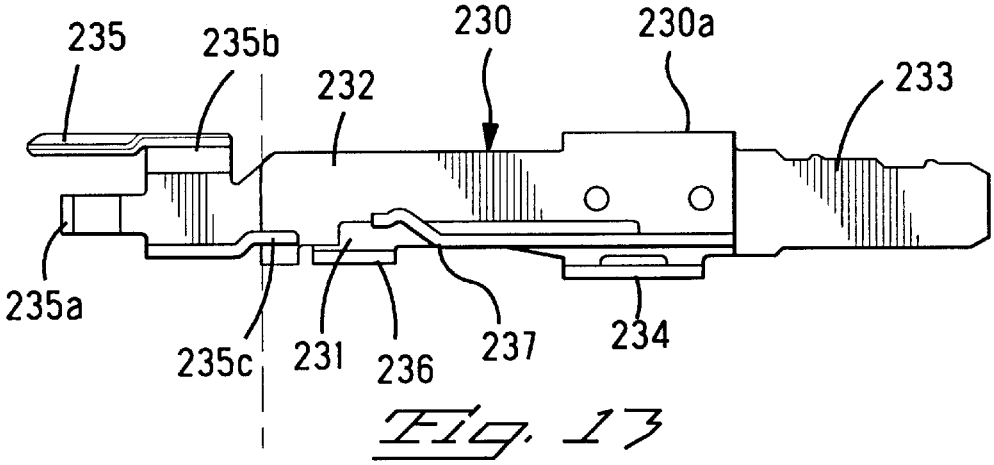
FIG. 13 is a right-side view of the latch member shown in FIG. 12.
Figure 14:
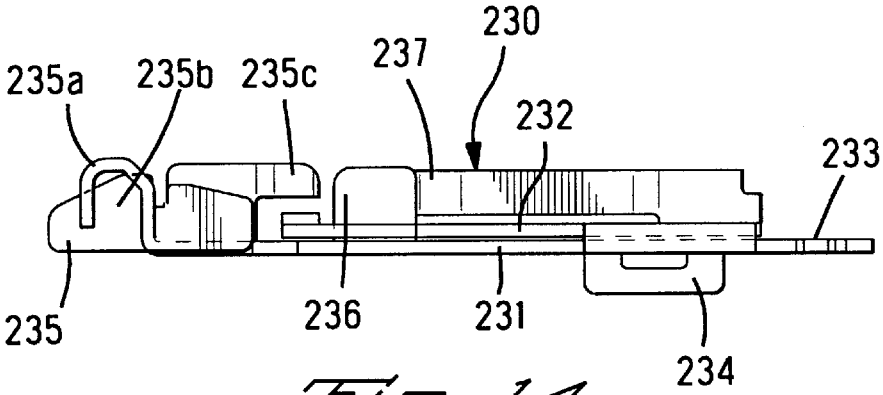
FIG. 14 is a bottom view of the latch member shown in FIG. 12.
Figure 15:
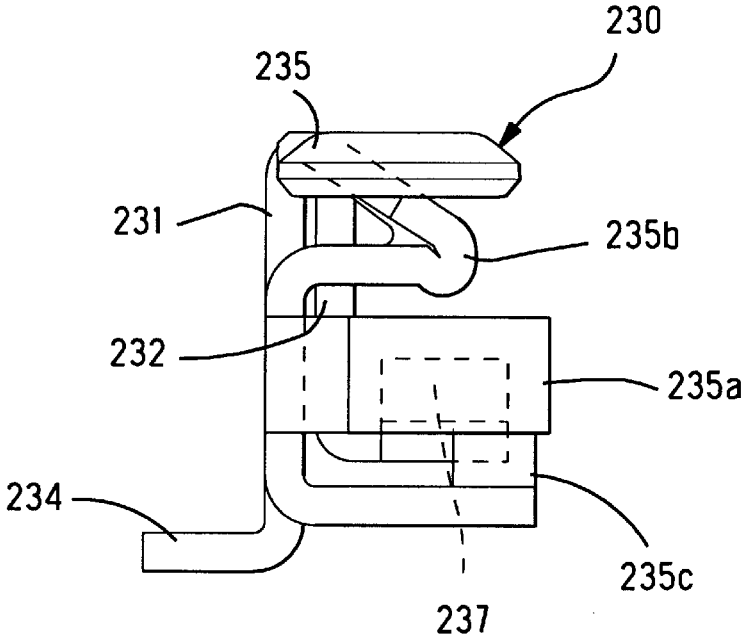
FIG. 15 is a front view of the latch member shown in FIG. 12.

As shown in FIGS. 10 and 11, the housing 210 is an integral member with insulating properties which is molded substantially in the shape of a rectangular solid with the daughter board-accommodating recess 211 extending in the direction of length inside. The housing 210 is formed by molding from a suitable insulating resin material. A pair of latch press-fitting recesses 212, which are used to fasten press-fitting sections 233 of the latch members 230 by press-fitting therein, are located in the vicinity of both ends of the housing 210 with respect to the direction of length of the housing 210. Furthermore, a rib 213 to prevent inverted insertion of the daughter board 250 is located in the vicinity of the right end in FIG. 11 of the daughter board-accommodating recess 211 with respect to the direction of length thereof. The rib 213 extends from an upper wall 214 of the daughter board-accommodating recess 211 toward a lower wall 215; however, a gap 216 is located between the rib 213 and the lower wall 215. If the rib 213 were connected to the lower wall 215 of the daughter board-accommodating recess 211, the lower wall 215 of the daughter board-accommodating recess 211 might be pulled by the rib 213 when the housing 210 is being molded, thus resulting in deformation. However, as a result of the gap 216, the lower wall 215 of the daughter board-accommodating recess 211 is not pulled by the rib 213, and it is therefore not deformed.

Figure 16:
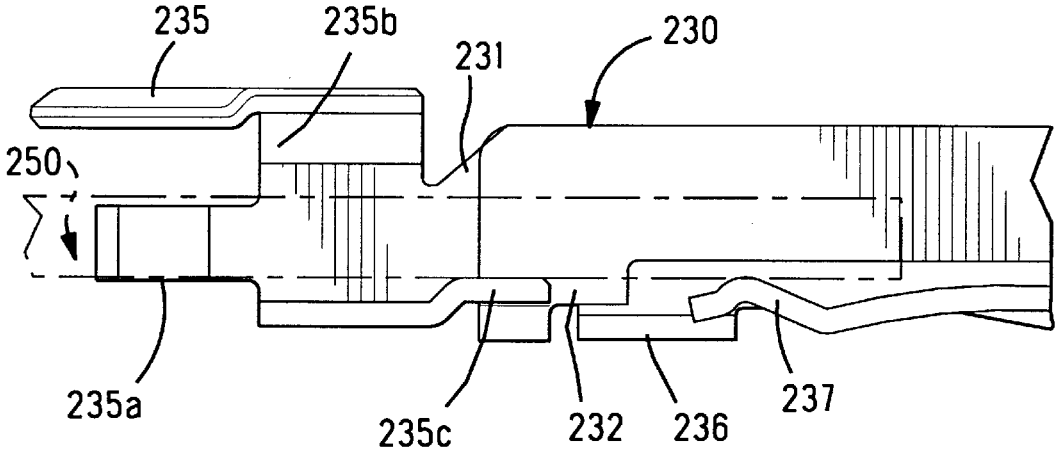
FIG. 16 is a part cross-sectional view illustrating the state in which the daughter board has been rotated to the second angle in the latch member shown in FIG. 12.

Furthermore, the latch members 230 are formed by stamping and forming metal sheets. As shown in FIGS. 12–16, each of the latch members 230 is equipped with flat sections 231, 232, that are folded and superimposed on each other via connecting section 230*a*. Moreover, the press-fitting section 233 is located at an inner end (i.e., the right end in FIG. 12) of plate section 231 and is press-fitted inside the latch press-fitting recess 212 of the housing 210. A connection section 234 is formed by being bent toward an outside (upper side in FIG. 12) from a lower end of plate section 231 and is connected by soldering to a ground path of the mother board 240. A daughter board-holding member 235 is positioned at an outer end of plate section 231 and holds the daughter board 250 at the second angle. An overstress-prevention section 236 is bent inward from the lower end of plate section 231. Furthermore, a resilient contact section 237 is bent inward from a lower end of plate section 232 and extends forward and resiliently engages the ground path of the daughter board 250. The overstress-prevention section 236 is positioned on an underside of the resilient contact section 237 and prevents excessive downward flexing thereof. As a result, there is no deformation of the resilient contact section 237. Furthermore, the overstress-prevention section 236 is positioned on the underside of the plate section 232 and engages the lower end of the plate section 232 when the daughter board 250 held by the daughter board-holding member 235 is forcibly driven upward, so that the plate section 231 is prevented from floating upward. As a result, there is no deformation of the daughter board-holding member 235 when the daughter board 250 is forcibly driven upward. The daughter board-holding member 235 is provided with a hook section 235*a*, which extends from the outer end of the plate section 231 and protrudes inward, a daughter board-holding portion 235*b*, which is bent inward from an upper end of the plate section 231 and an excessive movement-prevention portion 235*c*, which is bent inward from the lower end of the plate section 231. Here, as shown in FIG. 16, the daughter board-holding portion 235*b* temporarily moves to the outside as a result of the resilient force of the plate section 231 when the daughter board 250 inserted into the daughter board-accommodating recess 211 rotates from the first angle to the second angle; afterward, the daughter board-holding portion 235*b* returns to its original position and engages an upper surface of an edge portion of the daughter board 250 so that the daughter board 250 is prevented from floating upward. Furthermore, the hook section 235*a* enters a cut-out (not shown) in the edge portion of the daughter board 250 when the daughter board 250 is positioned at the second angle, so that the daughter board 250 is prevented from slipping out of the connector 201. The excessive movement-prevention portion 235*c* prevents excessive downward movement of the daughter board 250 when the daughter board 250 engages the resilient contact section 237 and also prevents excessive displacement of the plate section 231 to the outside by engaging the plate section 232 when the holding of the daughter board 250 is released by the displacement of the daughter board-holding portion 235*b* to the outside. Since the downward movement of the daughter board 250 is prevented by the excessive movement-prevention portion 235*c*, there is no separation of the daughter board 250 from the daughter board-holding member 235 in the position of the second angle. Furthermore, since the excessive movement-prevention portion 235*c* prevents the excessive displacement of the plate section 231 to the outside by engaging the plate section 232 when the holding of the daughter board 250 is released by the displacement of the daughter board-holding portion 235*b* to the outside, deformation of the plate section 231 that might otherwise occur when the holding of the daughter board 250 is released is prevented.

When the daughter board 250 is held at the second angle, as shown in FIG. 16, the resilient contact sections 237 of the latch members 230 are in electrical engagement with the ground path of the daughter board 250; furthermore, the connection sections 234 of the latch members 230 are electrically connected by soldering to the ground path of the mother board 240. Accordingly, the ground path of the daughter board 250 is grounded to the ground path of the mother board 240. The card edge electrical connector 201 shown in FIGS. 10–16 is more advantageous than the card edge electrical connector 1 shown in FIGS. 1–8 in that the grounding of the daughter board 250 to the mother board 240 is accomplished solely by means of the latch members 230, so that ground auxiliary contact members 40 are not used. Furthermore, even if the daughter board 250 should be further rotated from the second angle as a result of some external cause so that the daughter board 250 is separated from the daughter board-holding portions 235*b* of the latch members 230, the resilient contact sections 237 of the latch members 230 are in resilient electrical engagement with the ground path of the daughter board 250, so that there is no dissolution of the grounded state of the daughter board 250 with respect to the mother board 240. Moreover, when the daughter board 250 rotates from the first angle to the second angle, the resilient contact sections 237 electrically engage the ground path of the daughter board 250 and flex in a direction that causes an increase in the resilient force applied to the daughter board 250; accordingly, even if the daughter board 250 is further rotated from the second angle, the resilient force applied to the daughter board 250 by the resilient contact sections 237 increases greatly, so that separation of the resilient contact sections 237 from the daughter board 250 is reliably prevented, thereby insuring a much more reliable grounding connection of the daughter board 250 to the mother board 240.

In the card edge electrical connector of the present invention, metal ground auxiliary contact members, which have first resilient contact portions, that resiliently engage a ground path of the daughter board and second resilient contact portions that resiliently engage latch members, are attached to a housing; accordingly, the ground path of the daughter board is reliably grounded to a ground path of the mother board via the ground auxiliary contact members and latch members.

Furthermore, in the card edge electrical connector of the present invention, the first resilient contact portions of the ground auxiliary contact members are constructed so that they electrically engage the ground path of the daughter board and flex in a direction that causes an increase in the resilient force applied to the daughter board when the daughter board rotates from a first angle to a second angle; accordingly, even if the daughter board is further rotated from the second angle, the resilient force applied to the daughter board by the first resilient contact portions is greatly increased, so that separation of the first resilient contact portions from the daughter board is reliably prevented, thereby insuring a much more reliable grounding connection of the daughter board to the mother board.

In the card edge electrical connector of the present invention, resilient contact portions, which resiliently engage the ground path of the daughter board are integral portions of the latch members; accordingly, the ground path of the daughter board is reliably grounded to the ground path of the mother board by means of the latch members alone.

In the card edge electrical connector of the present invention, overstress-prevention sections, which prevent excessive flexing of the resilient contact portions, are integral sections of the latch members; accordingly, there is no deformation of the resilient contact sections when the ground path of the daughter board engages the resilient contact sections.

In the card edge electrical connector of the present invention, the latch members are equipped with flat sections, which are folded back and superimposed on each other. A connection section, which is electrically connected to a ground path of the mother board, a daughter board-holding section, which holds a daughter board at a second angle, and an overstress-prevention section, are integral sections of one of the plate sections, and a resilient contact section is an integral section of the other plate section. Accordingly, latch members of an integral structure equipped with a function that holds the daughter board, a function that securely grounds the daughter board to the mother board, and a function that prevents overstressing of the resilient contact section, can be simply manufactured.

In the card edge electrical connector of the present invention, the overstress-prevention section of each latch member engages the other plate section when the daughter board held by the daughter board-holding section is forcibly driven upward, so that the one plate section is prevented from floating upward. Accordingly, when the daughter board is forcibly driven upward, there is no resilient deformation of the daughter board-holding section on the one plate section.

In the card edge electrical connector of the present invention, an excessive-movement prevention section, which prevents excessive movement of the daughter board when the daughter board engages the resilient contact section, is an integral section of the one plate section; accordingly, there is no separation of the daughter board from the daughter board-holding section in the second angle position in which the daughter board is held by the daughter board-holding section.

In the card edge electrical connector of the present invention, the excessive-movement prevention section prevents excessive displacement of the one plate section to the outside by engaging the other plate section when the holding of the daughter board is released by the displacement of the daughter board-holding section to the outside. Accordingly, deformation of the one plate section that might otherwise occur when the holding of the daughter board is released can be prevented.

What is claimed is:

1. An electrical connector for electrical connection to a mother board and for receiving a daughter board, said connector comprising:

dielectric housing having a board-accommodating recess extending therealong in which an edge of the daughter board is to be accommodated;

electrical contacts mounted in the dielectric housing and having contact sections for electrical connection to the daughter board and connection sections for electrical connection to the mother board when the dielectric housing is mounted on said mother board; and metal latch members mounted in the dielectric housing adjacent respective ends of the board-accommodating recess and having connection sections for electrical connection to a ground path on the mother board, said metal latch members having board-holding members for engaging a surface of the daughter board and holding the daughter board at a second angle after the edge of the daughter board has been inserted into the board-accommodating recess at a first angle and then moved to the second angle, and said metal latch members having resilient contact sections for electrical connection to a grounding path on the daughter board.

2. An electrical connector as claimed in claim 1, wherein the board-holding members include plate sections defining mounting sections for engaging latch-mounting recesses in the dielectric housing.

3. An electrical connector as claimed in claim 2, wherein the plate sections include hook sections for engagement with cut-outs located in side edges of the daughter board.

4. An electrical connector as claimed in claim 1, wherein the metal latch members have first and second plate sections joined together at inner ends in a U-shape, the first plate sections have the connection sections and constitute mounting sections for engaging latch-mounting recesses in the dielectric housing, and the second plate sections have the board-holding members.

5. An electrical connector as claimed in claim 4, wherein the first plate sections have overstress-prevention sections disposed opposite the board-holding members.

6. An electrical connector as claimed in claim 1, wherein the metal latch members have first and second plate sections joined together so as to extend substantially parallel to each other, the first plate sections include press-fitting sections for being press-fitted into press-fitting recesses in the dielectric housing, the connection sections, and the board-holding members, the second plate sections include the resilient contact sections.

7. An electrical connector as claimed in claim 6, wherein the first plate sections include overstress-prevention sections under outer ends of the resilient contact sections.

8. An electrical connector as claimed in claim 6, wherein the first plate sections include excessive movement-prevention portions for preventing excessive downward movement of the daughter board when the daughter board engages the resilient contact sections.

9. An electrical connector for electrical connection to a mother board and for receiving a daughter board, said connector comprising;

a dielectric housing having a board-accommodating recess extending therealong in which an edge of the daughter board is to be accommodated;

electrical contacts mounted in the dielectric housing and having contact sections for electrical connection to the daughter board and connection sections for electrical connection to the mother board when the dielectric housing is mounted on said mother board;

metal latch members mounted in the dielectric housing adjacent respective ends of the board-accommodating recess and having connection sections for electrical connection to a ground path on the mother board, said metal latch members having board-holding members for engaging a surface of the daughter board and holding the daughter board at a second angle after the edge of the daughter board has been inserted into the board-accommodating recess at a first angle and then moved to the second angle; and metal ground contact members having resilient contact sections for electrical connection to a grounding path on the daughter board.

10. An electrical connector as claimed in claim 9, wherein the metal latch members have first and second plate sections joined together at inner ends in a U-shape, the first plate sections have the connection sections and constitute mounting sections for engaging latch-mounting recesses in the dielectric housing, the second plate sections have the board-holding members, and the metal ground contact members are equipped with press-fitting plate portions for being press-fitted into press-fitting recesses in the dielectric housing, the metal ground contact members further having resilient contact portions constituting the resilient contact sections with one of the resilient contact portions electrically engaging the metal latch members and another of the resilient contact portions electrically engaging the grounding path on the daughter board.

* * * * *